United States Patent [19]

Rest

[11] 4,127,269

[45] Nov. 28, 1978

[54] SHOCK ABSORBER AND ASSEMBLY

[76] Inventor: Frederick G. Rest, 175 E. Delaware, Apt. 8011, Chicago, Ill. 60611

[21] Appl. No.: 769,261

[22] Filed: Feb. 16, 1977

[51] Int. Cl.[2] ..... A63F 7/06

[52] U.S. Cl. ..... 273/85 D; 16/86 R; 267/140

[58] Field of Search ..... 273/85 D; 267/140, 141, 267/137, 153; 16/86 R, 86 B

[56] References Cited

U.S. PATENT DOCUMENTS

| | | | |
|---|---|---|---|
| 3,061,272 | 10/1962 | Elenburg | 267/137 |
| 3,625,501 | 12/1971 | Hein | 267/141 |
| 3,653,661 | 4/1972 | Leonhart | 273/85 D |

FOREIGN PATENT DOCUMENTS

| | | | |
|---|---|---|---|
| 834,474 | 8/1938 | France | 273/85 D |
| 990,467 | 6/1951 | France | 273/85 D |

*Primary Examiner*—Anton O. Oechsle
*Attorney, Agent, or Firm*—Richard G. Lione

[57] ABSTRACT

An improved shock absorber and shock absorber assembly, particularly suited for table games, which cushions the impact of a player figure against the surface of a journal in which the player figure shaft is mounted. It includes a shock absorber body molded of relatively dense rubber and a low coefficient of friction-bearing element molded unitarily therewith. A bore through the member has a cement which grips the shaft and another segment whose inner surface is spaced radially from the shaft. The external shape of the member is frusto-conical with the smaller end facing the playing figure.

3 Claims, 6 Drawing Figures

SHOCK ABSORBER AND ASSEMBLY

FIELD OF THE INVENTION

This invention is in the field of shock absorbers. It relates more particularly to shock absorbers for cushioning axial movement of the shaft and engagement of components on the shaft with its mounting journals.

BACKGROUND OF THE INVENTION

In manually operated games as table soccer, for example, a series of operator shafts are conventionally mounted in parallel, spaced relationship over a playing surface on the base of an elongated box which defines the playing field. The shafts are journaled in the side walls of the box for axial and rotational movement. Player figures are fastened to the shaft and move with it, their depending legs engaging and directing the ball at the instance of the operator who rotates the shaft and moves it axially, a handle on one end of the shaft outwardly of the shaft mounting journal is gripped by the operator to manipulate the shaft.

In moving the player figures, the game operator normally moves the shaft axially in sharp movements designed to position the player properly. Frequently the player figure is moved forcefully into engagement with a side wall journal. Repeated shocks which result from this kind of treatment in operation would normally be effective to damage the player figures and the box, if not cushioned. To this end it is conventional to use shock absorbers on the shaft between player figures and the side wall journals.

The shock absorbers presently in use are fabricated of various materials. Conventional coil springs are sometimes employed. By their various nature, such coil springs are inherently undamped and their shock resisting force increases linearly from initial compression to total compression. Sponge rubber shock absorbers, also common, act like coil springs in several respects. They do, however, provide a damping affect. Sponge rubber, however, is quite fragile and tends to deteriorate rapidly under repeated shock load. Dense rubber shock absorbers are also well known in this art. Constructed as they are for normal compression they provide relatively little displacement, however and, accordingly, minimal shock absorption. All of the known shock absorbers are bracketed by washers to permit the shaft to rotate easily when a player is drawn tightly against a journal. Most are loose on the shaft so that they rattle disconcertingly during game play.

SUMMARY OF THE INVENTION

It is an object of the present invention to provide a greatly improved shock absorber for axially movable and rotatable shafts. Another object is to provide a shock absorber particularly suitable for axially movable and rotatable shafts carrying player figures in games such as table soccer, for example. Another object is to provide a shock absorber for table game player figures which is fabricated primarily of dense rubber yet produces a movement resistance force slope of relatively low angle over its initial travel. Still another object is to provide a shock absorber which produces resistance force initially increasing on a relatively low slope to a point where it suddenly decreases to permit the player figure to move immediately adjacent to the side wall, whereupon the resistance force slope increases rapidly. Another object is to provide a shock absorber which does not require the use of separate washers to assure proper rotational movement of the shaft.

The foregoing and other objects of the invention are embodied in a shaft mounted shock absorber of unique configuration, composition and operation. The shock absorber is frusto-conical in external configuration. It has a stepped bore, cylindrical bore segment extends from the smaller end of the frusto-conical shock absorber body of a point approximately 40% of the axial length of the bore from that end. The remaining 60% of the length of the bore is made up of a larger diameter bore segment in the body.

The shock absorber is formed primarily of dense rubber by conventional molding techniques. Molded unitarily with it, and forming the base of the frusto-conical body surrounding the larger diameter bore segment, is a disk of relatively hard bearing material. This disk may be fabricated of many materials as long as it has good bearing characteristics in contact with the wall mounted journal which is normally fabricated of plastic.

The shock absorber is mounted on a player figure shaft with the shaft passing through the stepped bore of the body and the smaller end of the shock absorber engaging a player figure on the shaft. The diameter of the smaller bore segment is such that the shock absorber snugly grips the shaft. In this relationship the larger diameter bore segment, or more precisely, its inner-surface, is spaced from the shaft. The bearing surface disk faces the side wall mounted journal.

When an operator moves the shaft axially to bring the end most player figure adjacent to the side wall, the large end of the shock absorber body engages the side wall journal. Frequently substantial impact is involved in the heat of game competition. The shock absorber embodying the present invention begins to uniformly deform axially and becomes shorter. The body of the shock absorber bulges radially both outwardly and inwardly as shock is absorbed. Monotonously increasing force opposes and absorbs shock of movement of the shaft.

The smaller end of the shock absorber body then actually folds inside the larger diameter bore segment. At this point, resistance is sharply decreased and the player figure can move to a point immediately adjacent the wall. After this sudden inward folding of the shock absorber body and concomitant force resistance decrease, the shock absorber body reasserts itself in a rapidly increasing resistance to shaft movement, bringing such movement to a halt.

Meanwhile the shaft can be rotated freely while the shock absorber is in engagement with the wall journal. The bearing disk engages and provides a bearing surface permitting this rotation. The operator can thus easily cause a man to strike the ball even with the man drawn into a point immediately adjacent to the wall.

BRIEF DESCRIPTION OF THE DRAWING

The invention, including additional objects and advantages thereof, is illustrated more or less diagrammatically in the drawing, in which.

DESCRIPTION OF THE PREFERRED EMBODIMENT

Figure 1:
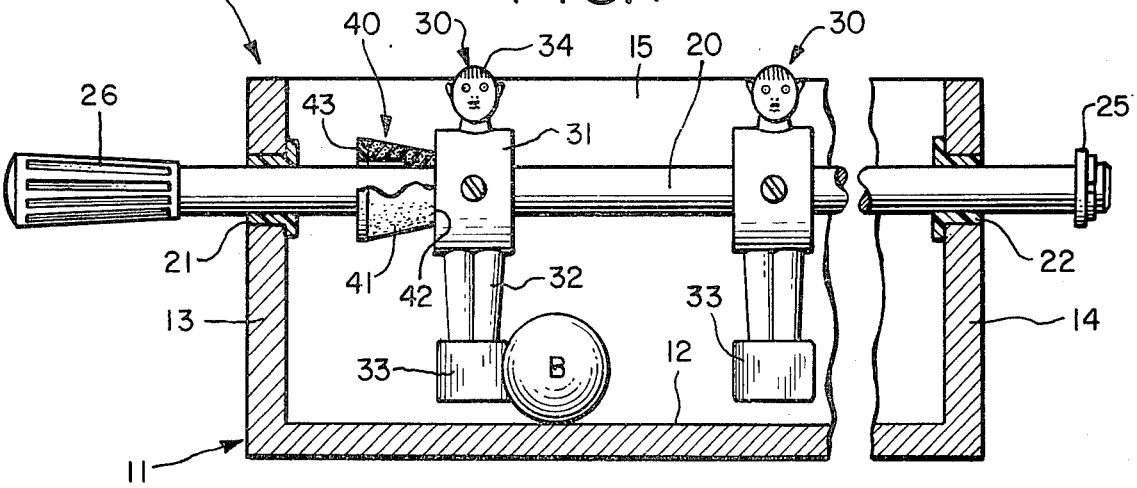
FIG. 1 is a vertical sectional view through a table soccer game illustrating a conventional shaft and player figure mounting and incorporating a shock absorber embodying features of the present invention.

Referring now to the drawing, and particularly to FIG. 1, a table soccer game of generally conventional construction is illustrated in vertical section at 10. That portion of the table soccer game 10 which is illustrated includes the open top box 11 which defines the playing field for the game. The playing surface 12 is illustrated on the base of the box and upstanding side walls 13 and 14 define the side boundaries of the game. There are, of course, end walls also, only one being shown in FIG. 1, at 15.

An operator shaft 20 is illustrated extending parallel to the base game playing surface 12 approximately 6 inches above the surface. Shaft 20 extends between and through the side walls 13 and 14, being mounted in plastic bearing journals 21 and 22, respectively, in the side walls 13 and 14. The shaft 20 is fabricated of metal, preferably steel, and is mounted in the journals 21 and 22 for sliding movement axially as well as rotation about its own axis.

A stop washer 25 is mounted on one end of the shaft 20, outside of the wall 14, and an operator handle 26 is mounted on the opposite end of the shaft, outside of the wall 13. By manipulating the handle 26, the operator can move shaft 20 axially, back and forth, between stops defined by the washer 25 on one end and the handle 26 on the other end. At the same time, or independently, the operator can rotate the shaft about its own axis.

The purpose of this movement of the shaft 20 by the operator is to actuate the player figure 30 rigidly mounted on the shaft 20. Actually there are a series of player figures mounted on the shaft for reasons which will hereinafter be obvious. Furthermore, there are a series of shafts extending parallel to each other along the length of the game table 10, also for reasons hereinafter made obvious. For purposes of discussion of the present invention, however, a single shaft and a single player figure is all that is necessarily described.

The player figure 30 comprises a torso 31 formed of a block of wood or plastic, for example. Depending from the torso 31 is a unitary leg 32 to which is appended a block-like foot 33. The figure 30 also has a head 34 provided on its upper end for appearance purposes. As was previously pointed out, the figure is rigidly attached to the shaft by a conventional means so that it moves with the shaft both axially or in rotation.

The game is played by causing the player figures 30 to "kick" an object ball B along the playing surface 12. This is accomplished by means which are obvious to the confirmed table game player. The operator moves the appropriate shaft 20 and figure 30 into position adjacent an object ball B by moving the shaft axially. He then rotates the shaft to cause the foot 31 on the figure 30 to impact against the ball and drive it along the length of the table surface 12. The object of the game is, of course, to drive the ball, through the manipulation of numerous shafts 20 and numerous figures 30 into your opponents goal. In the meantime, of course, an opponent operator is manipulating identical but oppositely arranged shafts with player figures on them to drive the ball toward your goal.

In playing the game, particularly when the operator is attempting to "kick" a ball B while it is against a side wall 13, the shaft 20 is frequently drawn abruptedly to the left, as seen in FIG. 1, to move the player figure 30 into a position immediately adjacent the wall 13. In doing so it is imperative that the shock of engagement of the player figure 30 with the journal 21 be cushioned to prevent damage to the game; either to the player figure, the bearing or the wall itself. This cushioning or shock absorbing as it is referred to is accomplished according to the present invention by a new and improved shock absorber 40.

The shock absorber 40 comprises a dense but resilient rubber body 41 which is mounted on the shaft 20 immediately adjacent the torso 31 of the player figure 30, as illustrated in FIG. 1. The shock absorber body 41 is molded by conventional techniques in a frusto-conical shape and positioned so that the smaller end surface 42 of the body normally engages one side of the torso 31 of the player figure 30; the side adjacent the wall 13, for example. Molded unitarily with the body 41 on the larger end thereof is a hard disk 43 formed of material having a relatively low coefficient of friction. For example, a hard plastic disk or a hard disk formed of a suitable type of rubber might be utilized. In the present instance a hard rubber disk having a low coefficient of friction is employed.

Figure 2:
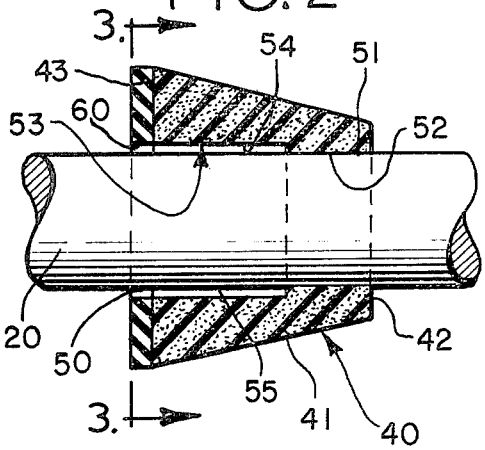
FIG. 2 is an enlarged sectional view taken through the shock absorber seen in FIG. 1.
Figure 3:
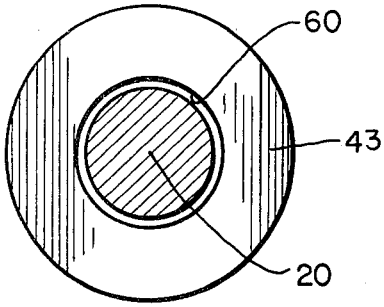
FIG. 3 is a sectional view taken along line 3—3 of FIG. 2.

Referring now to FIGS. 2 and 3, the shock absorber 40 is shown enlarged and in section. There it will be seen that the body 41 is pierced on its longitudinal axis by a stepped bore 50. An outer segment 51 of the bore, adjacent the smaller end 42 of the body, has a smaller diameter surface 52 corresponding substantially to the outer diameter of the shaft 20. This diameter is actually designed to provide a slight interference fit between the surface 52 and the shaft 20 to hold the shock absorber 40 snugly to the shaft 20 adjacent the torso 31 of the player figure 30. As illustrated, the smaller diameter bore segment 51 extends less than one-half the length of the entire bore from the smaller end 42 of the body 41.

The remaining portion of the bore 50 is made up of a larger diameter segment 53 thereof. The larger diameter of segment 53, extending from the larger end disk 43, has an inner surface 54 with a diameter sufficiently large that a gap 55 having a width hereinafter discussed is defined between the shaft 20 and the inner surface 54 of the bore segment 53. The disk 43 formed unitarily with the body 41 of the shock absorber 40 is relatively hard and thin and has a bore 60 through it with a diameter corresponding to the diameter of the larger bore segment 53 in the shock absorber body 41.

In operation, when the operator grasps the handle 26 and draws the shaft 20 and, accordingly, the player figure 30 rapidly toward the wall 13, the disk 43 engages the opposing surface 65 of the plastic wall journal 21 when the player figure 30 is approximately one inch from the wall. Further movement of the player figure 30 toward the wall 13 is, of course, resisted by the shock absorber 40 according to its capacity to do so.

Figure 6:
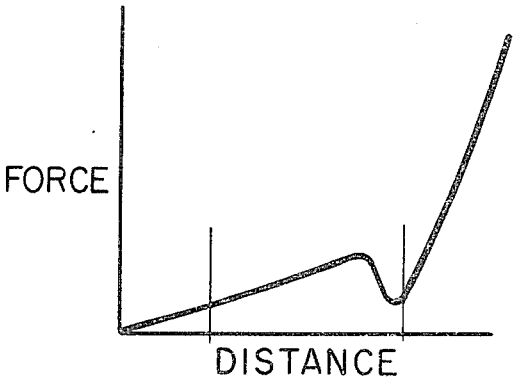
FIG. 6 is a graph illustrating the resilient force resistance of the shock absorber embodying features of the present invention as a function of shaft and player figure movement in compressing the shock absorber.

With the shock absorber 40 constructed according to the present invention the resistinng force rises monotonously as seen in FIG. 6, to a point where the shock absorber 40 has deformed (in a manner hereinafter discussed) to approximately one-half of its original length.

At that point, the substantial resistance then developed drops off dramatically and the player figure 30 is able to move in almost to the wall 13 before it reaches the wall 13, however, resistance force starts increasing rapidly on a substantially more inclined slope, as illustrated in FIG. 6.

Figure 4:
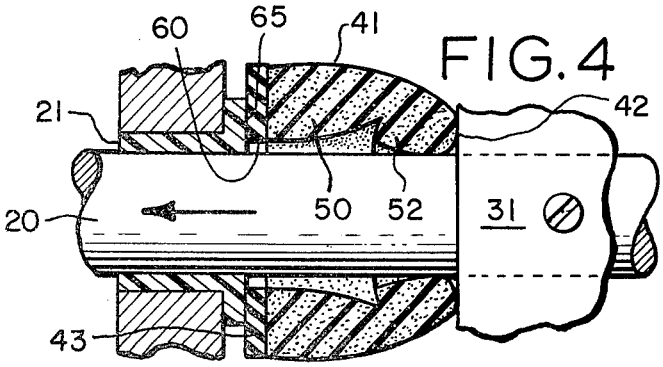
FIG. 4 is a sectional view similar to FIG. 2 showing the shock absorber during its initial stages of compression.
Figure 5:
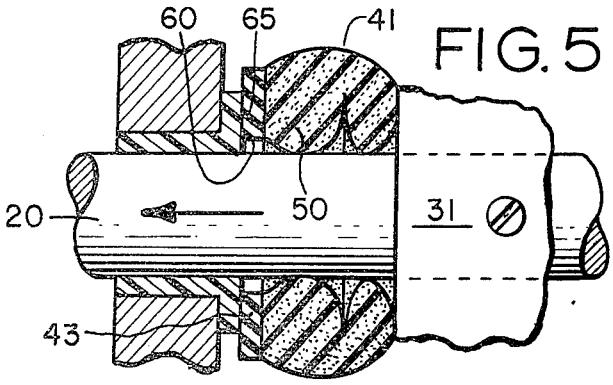
FIG. 5 is a view similar to FIG. 4 showing the shock absorber in its latter stages of compression.

The shock absorber is effective in absorbing shock of the impact of the player figure 30 by deforming in the manner illustrated in FIGS. 4 and 5. As seen in FIG. 4, initial deformation of the shock absorber body 41 is in the form of a bulging radially outwardly of the entire body as the torso 31 of the player figure presses against the smaller end 42 of the body, compressing it between the torso and the bearing 21 in the side wall 13. At the same time the body 41 is permitted to bulge inwardly in the region of the gap 55.

The body 41 continues to bulge while the smaller end of the frusto-conical shape is forced to the left, as seen in FIG. 6, until over a very short distance, the smaller end of the body actually folds against the now outwardly flared bore 50. Up to the point where this folding takes place, the aforementioned inward bulging continues unimpeded by engagement with the shaft due to the pre-selected width dimension of the gap 55. When folding does take place, the resistance force drops suddenly, as illustrated in FIG. 6. With this portion of the body folded, continued movement of the player figure 30 toward the bearing 21 meets greatly increased resistance and the shock resisting force rises rapidly, as also seen in FIG. 6.

In the drawings and specification, there has been set forth preferred embodiments of the invention, and although specific terms are employed, these are used in a generic and descriptive sense only, and not for purpose of limitation. Changes in form and proportion of parts, as well as substitution of equivalents are contemplated, as circumstances may suggest or render expedient, without departing from the spirit or scope of this invention, as further defined in the following claims.

I claim:

1. A shock absorber member, comprising:

a. a body formed of dense rubber and containing an axial bore through which a shaft is adapted to extend, b. said body having a frusto-conical external configuration with said bore extending between the smaller diameter end and the larger diameter end thereof, c. said bore including a first circular cylindrical segment opening out of said smaller diameter end and a second circular cylindrical segment of larger diameter than said first segment opening out of said larger diameter end, and d. a hard rubber disk having a relatively low coefficient of friction molded unitarily with said dense rubber body on said larger diameter end.

2. In a table game or the like wherein a shaft is axially and rotationally movable in a wall mounted journal and a radially extending figure is affixed to the shaft, an improved shock absorber assembly for cushioning the impact of said figure against a surface on the wall, comprising:

a. a shock absorber member mounted on said shaft immediately adjacent said figure between said figure and said surface, b. said member comprising a body formed of resilient material with a larger diameter end and a smaller diameter end and containing an axial bore through which said shaft extends, c. a first segment of said bore immediately adjacent said figure having cross-sectional dimensions such that said first bore segment snugly grips said shaft and said member is movable with said shaft, and d. a second segment of said bore having cross-sectional dimensions such that an inner surface of said second bore segment is spaced radially outwardly from said shaft, e. said member being deformed against said surface as said figure is moved toward said surface, the resistance force to such movement created by the deforming member initially increasing on a relatively low slope to a point where it suddenly decreases to permit the figure to move immediately adjacent said wall, after which further movement is against rapidly increasing resistance force, f. said member also comprising a relatively low friction coefficient bearing element molded unitarily with said body on said larger diameter end of said body, g. said bearing element engaging said surface when said figure is drawn sufficiently toward said surface and permitting easy rotation of the shaft in such relationship.

3. In a table game or the like wherein a shaft is axially and rotationally movable in a wall mounted journal and a radially extending figure is affixed to the shaft, an improved shock absorber assembly for cushioning the impact of said figure against a surface on the wall, comprising:

a. a shock absorber member mounted on said shaft immediately adjacent said figure between said figure and said surface, b. said member comprising a body formed of resilient material with a larger diameter end and a smaller diameter end and containing an axial bore through which said shaft extends, c. a first segment of said bore immediately adjacent said figure having cross-sectional dimensions such that said first bore segment snugly grips said shaft and said member is movable with said shaft, and d. a second segment of said bore having cross-sectional dimensions such that an inner surface of said second bore segment is spaced radially outwardly from said shaft, e. said body being molded of dense rubber material with a frusto-conical shape having a smaller diameter end facing said figure and a larger diameter end facing said surface, f. said first segment of said axial bore opening through said smaller end of said body and having a circular cylindrical cross-sectional configuration, g. said second segment of said axial bore opening through said larger end of said body and having a circular cylindrical cross-sectional configuration, h. said member being deformed against said surface as said figure is moved toward said surface, the resistance force to such movement created by the deforming member initially increasing on a relatively low slope to a point where it suddenly decreases to permit the figure to move immediately adjacent said wall, after which further movement is against rapidly increasing resistance force, i. said member also comprising a hard rubber disk having a relatively low coefficient of friction molded unitarily with said dense rubber body on said larger diameter end of said body, j. said disk engaging said surface when said figure is drawn sufficiently towards said surface and permitting easy rotation of the shaft in such relationship.

* * * * *